United States Patent [19]

Mathews

[11] 4,271,541

[45] Jun. 9, 1981

[54] APPARATUS FOR INTERMITTENT DELIVERY OF FLUID UNDER PRESSURE

[76] Inventor: Lester R. Mathews, 9810 N. 37th St., Phoenix, Ariz. 85028

[21] Appl. No.: 82,182

[22] Filed: Oct. 4, 1979

[51] Int. Cl.[3] ..... E04H 3/16; E04H 3/18; E04H 3/20

[52] U.S. Cl. ..... 4/490; 134/167 R; 134/168 R; 239/5; 239/206; 4/492

[58] Field of Search ..... 4/490, 492, 496, 507; 210/169; 134/167 R, 168 R; 239/5, 6, 200, 206

[56] References Cited

U.S. PATENT DOCUMENTS

| | | | |
|---|---|---|---|
| 3,045,829 | 7/1962 | Rule | 210/169 |
| 3,247,969 | 4/1966 | Miller | 210/169 X |
| 3,408,006 | 10/1968 | Stanwood | 134/167 R X |
| 3,506,489 | 4/1970 | Baker | 134/10 |
| 3,521,304 | 7/1970 | Ghiz | 4/490 |
| 3,675,252 | 7/1972 | Ghiz | 4/490 |
| 3,770,203 | 11/1973 | Dyar | 239/205 |
| 4,188,673 | 2/1980 | Carter | 4/490 |

*Primary Examiner*—Henry K. Artis
*Attorney, Agent, or Firm*—Charles E. Cates; Victor Myer

[57] ABSTRACT

Apparatus for intermittent delivery of a fluid under pressure wherein a plunger having a conduit is disposed in a housing for reciprocal, rotary motion and responsive to fluid pressure at the intake end, by means provided in the plunger pops out of the housing and rotates a pre-selected number of degrees. Means are provided to stop both rotary and axial movement simultaneously.

16 Claims, 15 Drawing Figures

APPARATUS FOR INTERMITTENT DELIVERY OF FLUID UNDER PRESSURE

BACKGROUND OF THE INVENTION

This invention relates to an improvement in devices for intermittent delivery of fluid under pressure. In a more specific embodiment, it relates to improvements in such devices for delivery of water to pools; and in its most pertinent application it relates to the use of pop-up heads to deliver water for cleaning and scrubbing purposes in swimming pools.

In the prior art, various devices have been invented for the purpose of delivering water to swimming pools for the specific purpose of scrubbing the interior walls and floors thereof, or simply to agitate the water and put the fine solids in suspension to facilitate their removal by the filtering system of the swimming pool. Such devices progressed from stationary protrusions from the walls of the swimming pool which direct a continuous stream of water in one direction only to rotary heads which deliver a constant stream of water from either stationary or pop-up heads to pop-up heads which deliver a stream of water which changes in angular direction on successive intermittent uses of the head.

An example of the fixed protruding type which introduced a steady flow of fluid into a swimming pool may be found in U.S. Pat. No. 3,045,829 to Rule. An example of a fixed protruding head that delivers water from a constantly rotating head may be found in U.S. Pat. No. 3,247,969 to Miller. An example of a head which is rotated constantly to deliver fluid jets may be found in U.S. Pat. No. 3,675,252 to Ghiz and in U.S. Pat. No. 3,770,203 to Dyar. An example in the prior art of a swimming pool head adapted to intermittent delivery of a jet of water in a general direction may be found in U.S. Pat. No. 3,506,489 to Baker and in U.S. Pat. No. 3,408,006 to Stanwood. The fundamental purposes of all of these devices is to stir up the sediment and debris deposited on the walls and floor of the swimming pool so that it may be put into suspension in the water and removed from the water by the pool filter system.

An inspection of the references cited will show that for esthetic reasons the ideal water delivery head will be of the pop-up nature which is flush with the walls of the pool when not in use and which pops up for delivery of a stream of water. Functionally, to avoid the swirl effect, ideally the stream should be ejected from the head in a straight line, and the action should be intermittent in view of limited pressure values of the pool system.

In the prior art the latter objective has been accomplished by seriatim, intermittent routing of a supply of fluid under pressure to a plurality of lines, each of which has a head at the end. This is accomplished by means of a valving arrangement that distributes water seriatim to the various lines and their associated heads.

However, there are a number of problems with the prior art devices remaining to be solved. One of the problems is the complexity of the mechanism used to advance the heads. Another problem is the susceptibility of complicated mechanisms to disablement due to small bits of sediment suspended in the water and drawn into the mechanism. Yet another problem is the difficulty of servicing the prior art devices once installed, instances of which are the necessity of servicing the heads while submerged in the swimming pool in which they are installed. Yet another problem is the increased cost which necessarily goes along with making a complex mechanical structure.

BRIEF SUMMARY OF THE INVENTION

For the purpose of overcoming the defects of prior art devices, solving a significant portion of the prior art problems such as making the devices less complicated to manufacture, more reliable, and less complicated and expensive to service once installed, I have invented an apparatus for delivering a stream of fluid under pressure from a source thereof which is responsive to intermittent pressure from said source of fluid and rotates a selected number of degrees between deliveries.

Briefly, my apparatus for intermittent delivery of a fluid under pressure has a hollow, cylindrical housing and a cylindrical plunger fitted for rotatable, reciprocal motion within the housing. The plunger has a body, means defining a delivery head at one end of the body, and means defining a valve head or piston at the other end of the body. Operatively associated with the cylinder and plunger are means defining an axial fluid conduit communicating between the two ends of the body and defining an intake orifice in the piston end and a delivery orifice adapted to direct the flow of fluid under pressure in a selected direction from the delivery head. There are also operatively associated with the foregoing elements means for reciprocating and incrementally rotating the plunger body within the housing between a ready position, wherein the head is flush with an end of the housing and a pool wall, and a fluid delivery position wherein the head is extended out of the housing.

Means are provided for incrementally rotating and axially advancing the body responsive to pressure from the source of fluid wherein at least one bore is disposed in the body at an angle to the direction of fluid flow whereby the fluid pressure will rotate the plunger by exerting force against the inclined plane of the bore.

Also provided are means for simultaneously limiting the axial travel of the body to establish a delivery position and a ready position, and means for returning the body to the ready position.

The presently contemplated best use of the apparatus is as a water delivery head for swimming pools. Conveniently the piston is in the form of a flange carried at an end of the body and the bore is a plurality of bores in and through the piston communicating between the high pressure side of the piston and the low pressure side, with the addition of relief ports in the body downstream of the piston communicating between the low side of the flange and the interior of the conduit. In another embodiment the bore communicates with and extends radially outward from the axial conduit, but offset from the axial center thereof to the exterior, and may be tapered to the exit point. The bore may also define a dog leg path between the axial center and the perimeter of the head. In yet another embodiment the bore may be a combination of the bores in the piston and the angled bore in the delivery head.

Conveniently, the means for limiting the outward axial and rotary travel of the plunger toward the delivery position is a removable internal rim extending radially inward from the interior walls of the housing, and cooperating with means carried by the plunger for frictionally engaging the rim, such that when the two contact the rotary motion is halted in addition to the axial motion.

For example, the plunger body has an elongate narrowed waist portion or rod which is received within axially disposed circular guide means for keeping the plunger axially centered. Stop means for engaging the larger portion of the body as it advances to the delivery position is a removable plate having an axial aperture, or a split ring, carried in a groove in the interior wall of the housing and, optionally, a plug removably retained in place by the protruding rim of the split ring and a shoulder provided by relieving a portion of the housing's inner wall. The contacting surfaces are provided with at least one friction layer conveniently made of rubber or other elastomeric material.

Means for adjusting the stroke of the plunger are provided, conveniently an adjustable washer disposed on the waist between the tab and the head.

Conveniently, the means for returning the plunger to the ready position may be a helical spring disposed around the plunger and which is compressed when the plunger is advanced from the ready to the delivery position by the pressure of the fluids, thus, overcoming the force of the spring. When the pressure is removed the spring returns the plunger to the ready position.

To prevent interior fouling of the conduit and the relief ports the bores, when provided in the piston flange, should be made smaller in diameter than the relief ports.

All parts of the mechanism within the housing are removable for servicing at a more convenient place.

DETAILED DESCRIPTION OF THE PREFERRED EMBODIMENTS

A more detailed and complete understanding of the invention may be gained from consideration of the attached drawing in which.

Figure 1:
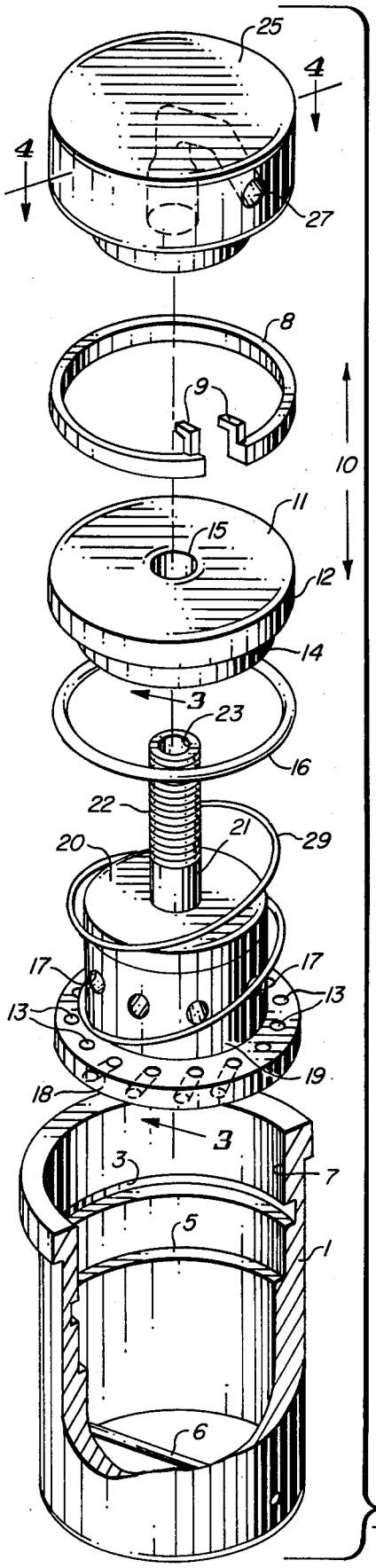
FIG. 1 is an exploded perspective view of a presently preferred embodiment of the device.
Figure 14:
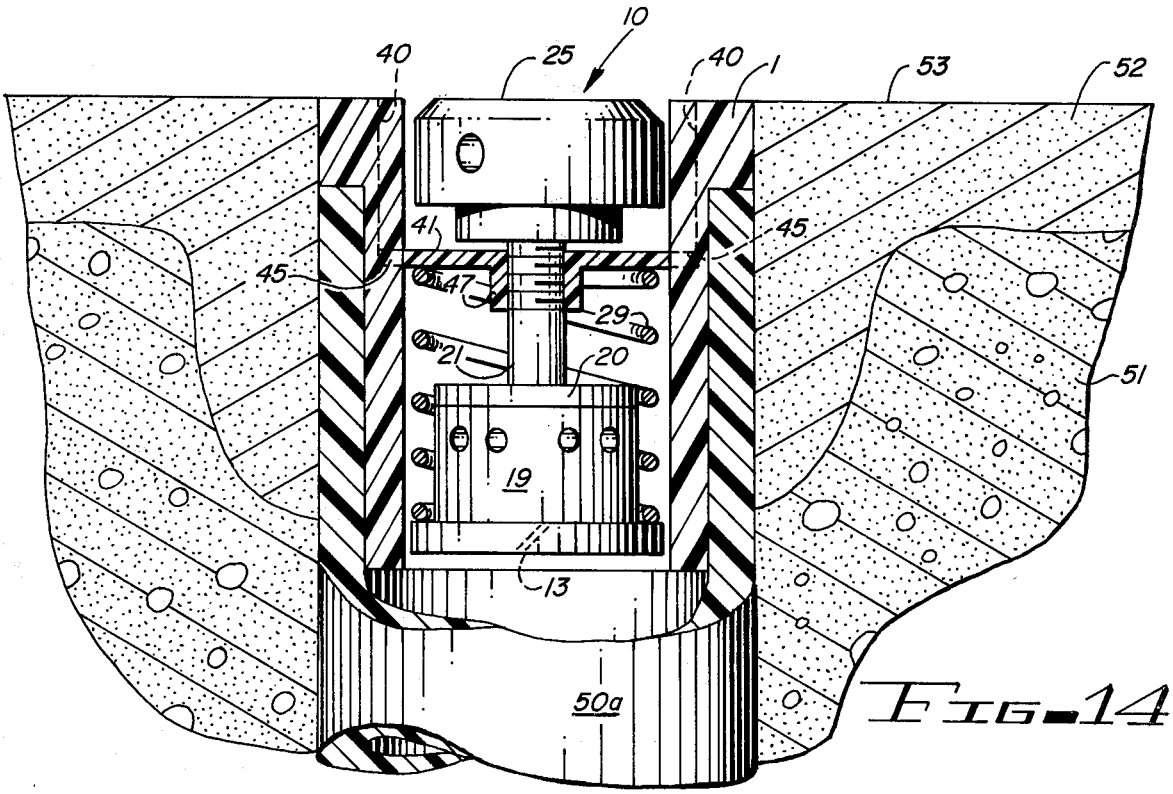
FIG. 14 is a view of an assembled apparatus made according to the teachings of this invention, partly in section, illustrated as it appears in place in a pool environment.

Referring to FIGS. 1 and 14 in which preferred embodiments of the invention are shown, the housing 1 is PVC pipe machined or injection molded to fit into a two-inch inside diameter water conduit (in general use for swimming pool filter systems) into which the housing is fitted and glued for use. The lip 2 covers and finishes the end of the outer conduit 50 (not a part of the invention).

Figure 2:
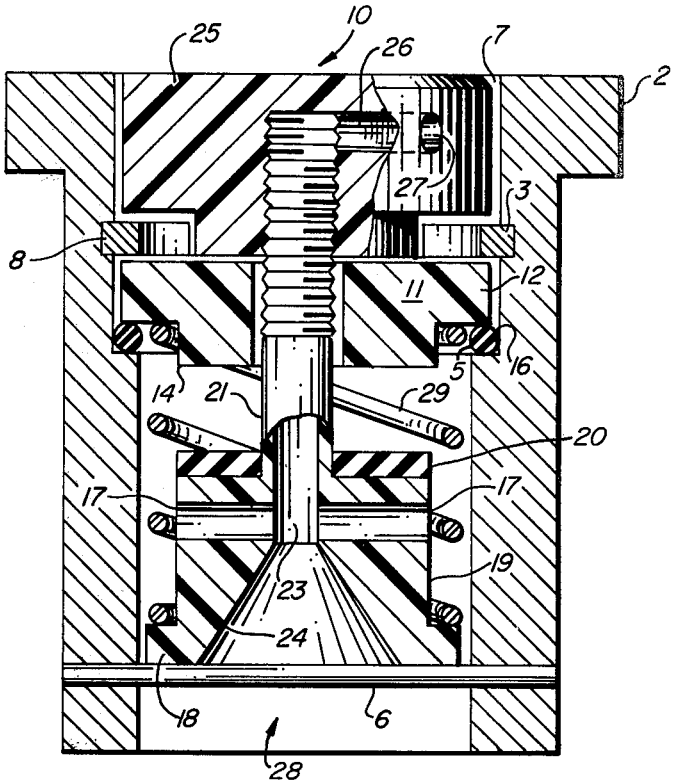
FIG. 2 is an integrated elevation view of the device of FIG. 1, taken in cross-section.

As seen in FIGS. 1 and 2 the inner wall 7 of the housing is relieved from the lip end through part of its length, creating shoulder 5 whose purpose will be explained presently. Formed in the relieved portion of the inner wall 7 is a circumferential groove 3 provided for the reception of split ring 8.

The flange 12 of plug 11 rests on the shoulder 5 and is retained securely between split ring 8 and shoulder 5. Plug 11 is provided with an axially centered aperture 15 for the reception of the waist 21 of the lower body 19 as will be presently explained. The shank 14 of the plug 11 is fitted with an O-ring 16 which provides an essentially water-tight seal between the plug 11 and the inner wall 7 of the housing 1.

Figure 3:
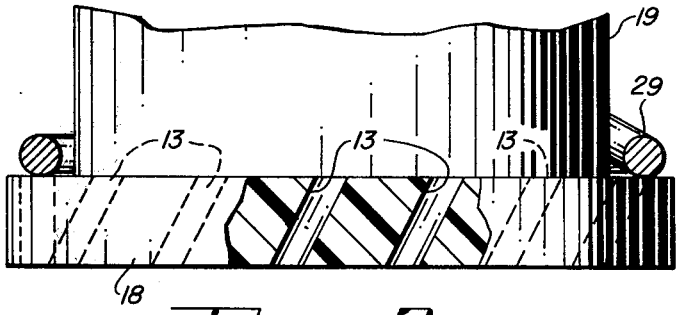
FIG. 3 is an enlarged view of a portion of the body shown in FIG. 2 including the piston flange (and shoulder), partly in cross-section, taken along the lines 3—3.
Figure 4:
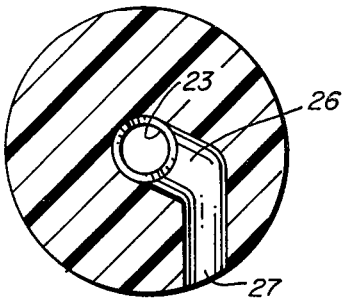
FIG. 4 is a plan view of the delivery head, in cross-section, taken along the lines 4—4.

Somewhat loosely fitted within the cylindrical housing 1 is a plunger 10 which has a head 25, a waist 21 and a lower body 19. The latter has a piston flange 18 the perimeter of which loosely fits the inside diameter of the housing. As illustrated in FIG. 3 the flange 18 carries rotator bores 13 annularly disposed on the axis of the body.

The plunger body rotates when the force of water moving into the housing in the direction of the arrow 28 impinges on the plane of the bores 13. The angular degree of the turn is controlled by adjusting two cooperating functions: (1) the angle of the bores 13 relative the longitudinal axis of the plunger and (2) the length of the plunger stroke. The required values may be determined for a particular purpose without undue experimentation.

Relief ports 17 are provided to permit water going through bore 13 to enter axial bore 23 to relieve pressure between flange 18 and plug 11. A spring 29 is coiled around the lower body and waist and bears on the flange 18 and the plug 11. The waist 21 is provided with external threads 22 which mate with internal threads 30 in head 25. In the head 25 axial bores 23 branches off into radial bore 26 which is in turn connected to angular bore 27 which may impart angular rotation along or in cooperation with bores 13.

Figure 5:
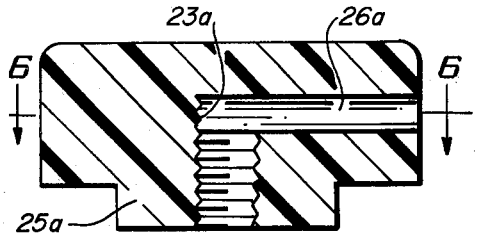
FIG. 5 is an elevation view of an alternative embodiment of the delivery head, in cross-section.
Figure 6:
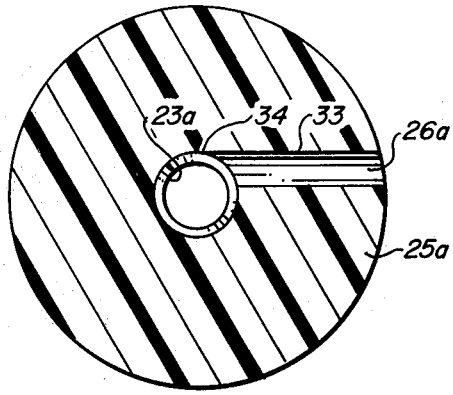
FIG. 6 is a plan view of the delivery head of FIG. 5, in section, taken along the lines 6—6.
Figure 7:
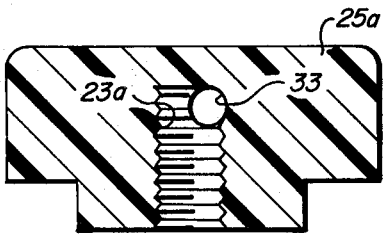
FIG. 7 is an elevation view, in section, of the delivery head of FIG. 5 rotated ninety degrees.

An alternative presently most preferred embodiment of the delivery head 25 is shown in FIGS. 5 through 7 inclusive wherein the radial bore **26*a* is offset such that its outer perimeter 33 is tangent to the perimeter 34 of the circle described by a cross-section of axial bore 23*a*. The force of the fluid current impinging on the offset radial bore is in itself sufficient to impart rotational movement to the plunger 10**.

In another most preferred embodiment the axial bore is larger in relation to the head than appears in these figures. For example, the axial bore **23*a* diameter is ¾ inch and the depending portion of the head 25*a* is one-inch in diameter. The radial bore 26*a* diameter is about one-half inch at axial bore 23*a*** tapering to three-sixteenths inch at the head perimeter exit point.

Figure 9:
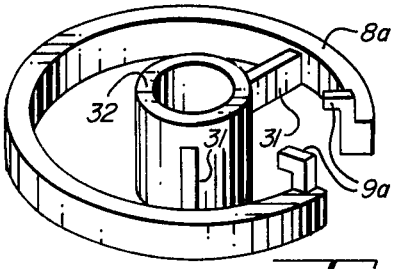
FIG. 9 is a perspective view of the split ring of FIG. 8.
Figure 8:
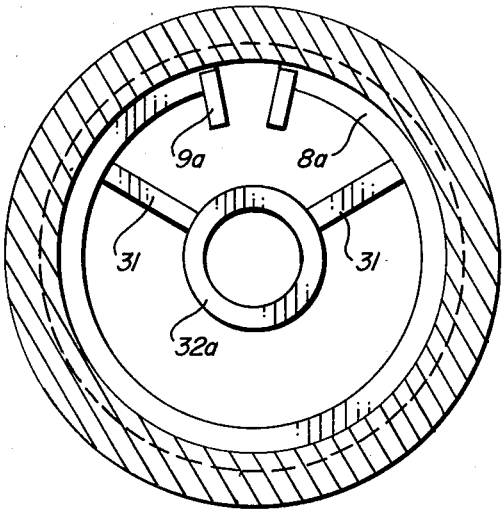
FIG. 8 is a view of another preferred alternative embodiment of the split ring and plunger stop feature in place in the housing, which is shown in cross-section.

In FIGS. 8 and 9 a preferred alternative embodiment of the invention features a split ring 8*a* which incorporates a guide ring 32*a* held in place by spokes 31. When used in conjunction with means for applying rotational movement of the plunger embodied in the delivery head such as shown in radial bores 26 and 26*a*, ring 8*a* may be used in lieu of the two-piece combination comprising split ring 8 and plug 11, inasmuch as it is not required that the plug be solid in order to channel the water into the axial bore 23 through relief ports 17. In that case there are no ports 13 in flange 18 which accordingly serves the usual function of a piston head.

Figure 11:
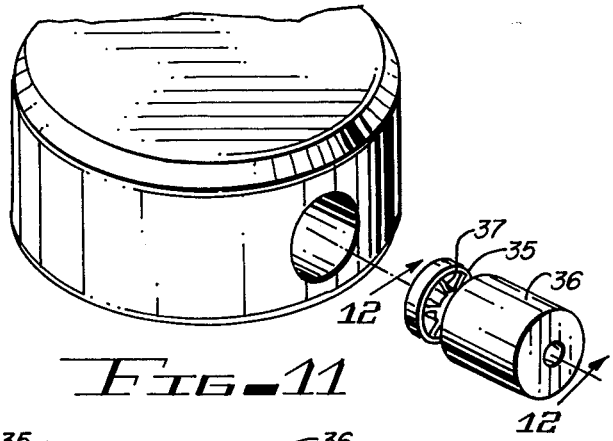
FIG. 11 is a perspective view, partly exploded, of yet another preferred embodiment of the delivery head of this invention.
Figure 12:
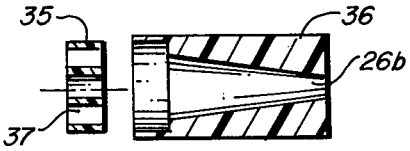
FIG. 12 is a view in section, taken along the lines 12—12, of the insert to the head depicted in FIG. 11.

Yet another preferred alternative to the features shown in FIGS. 5 through 7 is illustrated in FIGS. 11 and 12 wherein the head is provided with an insert (for ease of manufacture). A radial bore 26*b* is tapered from its communication with axial bore 23*a* to the perimeter of the head 25*a*, and a stream straightener 35 is placed in the insert 36 at the end communicating with the axial bore. The stream straightener 35 has a series of webs 37 extending between the perimeter and the axis of the stream straightener. Their function is to break up the rotational momentum of the water stream as it rounds the bend connecting the axial bore and the radial bore. As the water is forced from the wide end of the radial bore 26 through the smaller radial bore 26*b* it straightens and increases in velocity, resulting in greater pressure and less dispersion of the stream as it leaves the delivery head.

Figure 10:
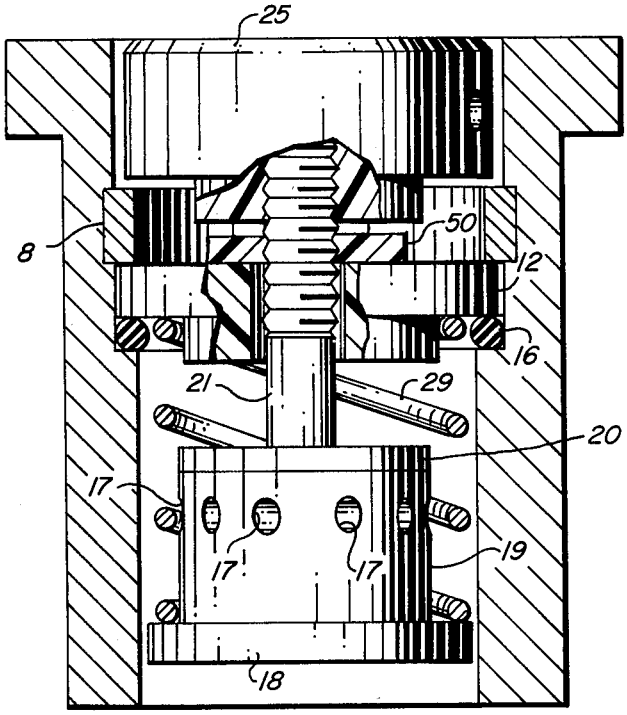
FIG. 10 is a view of yet another preferred embodiment of this invention wherein the housing is depicted in section and the interior workings are depicted partly in section.

Another highly preferred feature is shown in FIG. 10 wherein the means for adjusting the stroke of the plunger is found in the use of adjustable washer 50. Whereas in other embodiments shown the stroke is established in the manufacturing process by the length of the stroke (subject to some adjustment capability in the field by moving the head 25) in cooperation with the angle and size of apertures 13, the feature depicted in FIG. 10 permits a wide range of adjustments in the field because the length of the stroke governs the degree of angular rotation, all other factors being equal. Conceivably, variations from specifications of fluid pressure, or desired angular rotation per cycle, may occur that will make field adjustments necessary. Washer 50 facilitates delicate and precise adjustment.

It also serves a dual purpose in preventing the dropping of the plunger into a vertical pipe when the head 25 is removed, and makes the use of pin 6 unnecessary.

Figure 13:
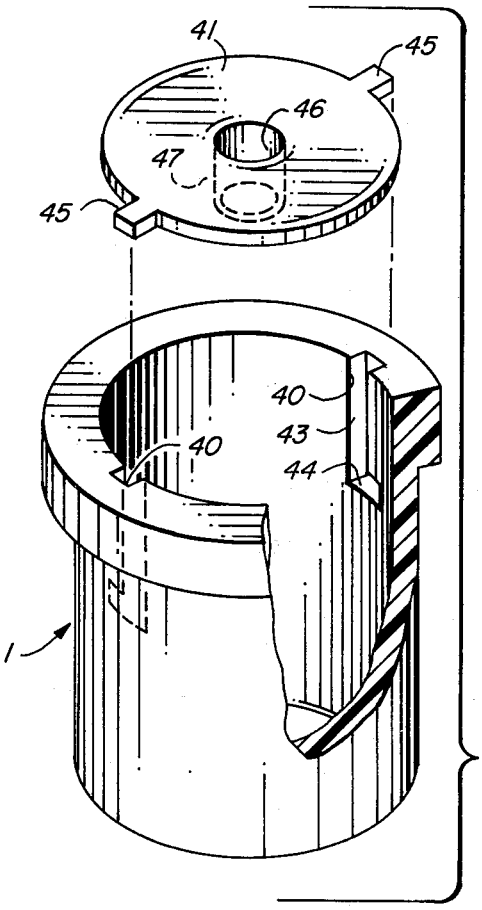
FIG. 13 is an exploded view, in perspective, of an alternative preferred embodiment of the invention wherein the housing is partially cut away to show interior details.
Figure 15:
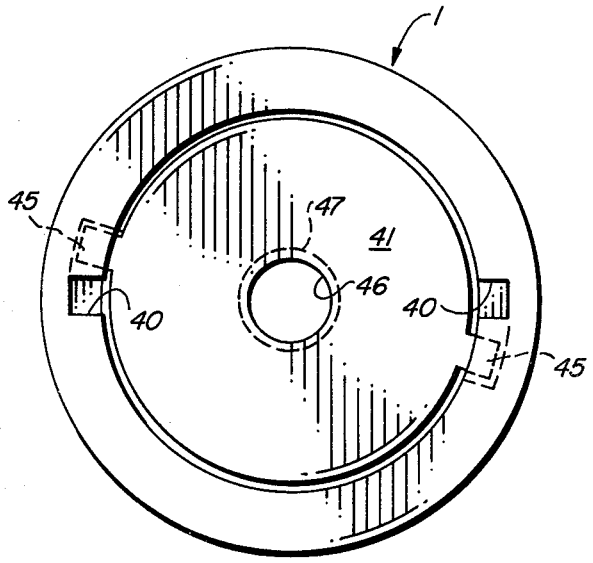
FIG. 15 is a plan view of the embodiment illustrated in FIG. 13.

Referring now to FIGS. 13, 14 and 15 in which an alternative preferred embodiment of the guide and stop member combination is depicted, guide plate 41 replaces the combination of plug 11 and split ring 8 and as a one piece element duplicates the function of both. Housing 1 is provided with opposed slots 40 having vertical legs 43 and horizontal legs 44, the slots 40 being disposed on opposite sides of the housing wall with the horizontal legs 44 turned in opposite directions to provide a bayonet type joint for the reception of the fingers 45 on guide plate 41. The plate 41 is inserted in the vertical slot 43 and lowered to horizontal slot 44 where the fingers 45 are secured with a twist. They are removed by the opposite procedure.

An axial aperture 46 is provided in the guide plate 41 for the reception of waist 21 of the plunger 10. The sizes of the waist 21 and cooperating axial aperture 46 may be larger than shown in various embodiments. The one side of guide plate 41 also serves as a stop means to limit the axial and rotational travel of the plunger body as explained previously in other embodiments.

Referring to FIG. 14, the apparatus of this invention is shown in its pool environment. Numeral 51 indicates the gunited area of a cross-section of a swimming pool wall. The plaster layer is indicated at 52. The pool manufacturer lays in a conduit 50*a* connected to a remote supply of water under pressure, typically controlled by a valve (not shown). Enough space between the end of the conduit 50*a* and the pool surface 53 is left to accommodate the lip 2 of housing 1. The housing is inserted into the conduit and cemented in place. As explained before, the plunger 10 and associated elements may be easily inserted and removed from the housing.

The manufacture of the apparatus may be carried out with methods and materials well known to persons ordinarily skilled in the art. The housing, for example, is made of polyvinylchloride plastic (PVC) and may be molded by any suitable standard procedure. The internal working parts are made of Delryn brand plastic, excepting O-ring and spring.

It is possible to deliver thirty to forty gallons per minute by means of this invention compared to three gallons per minute in a prior model which did not incorporate all of the present features. This makes it possible to clean a greater area of swimming pool surface with fewer heads, as will be appreciated by those skilled in the art.

OPERATION OF THE DEVICE

The apparatus is installed in a swimming pool with the delivery head end of the housing flush with the pool wall; typically, in a two-inch inside diameter pipe as above explained. It is contemplated that the apparatus be used in conjunction with a remote valve which will direct intermittent streams of water to successive ones of conduits communicating with individual embodiments of this invention. Considering only one such apparatus for the purpose of discussion and illustration, when the remote valve sends a flow of water under pressure in the conduit associated with the apparatus, the water impinges upon and exerts pressure upon flange 18 which compresses spring 29 and advances the plunger body axially causing delivery head 25 to pop-up from the housing and simultaneously rotating the plunger until both the axial and rotary movement of the plunger are halted by frictional engagement of plug 11 and rubber washer 20. When the delivery cycle programmed into the valve is completed the spring 29 will return the plunger to the retracted position (flush with the end of housing 1).

To service the apparatus the repairman will first unscrew delivery head 25 and remove split ring 8 by engaging bosses 9 with needle-nose pliers and squeezing and pulling the ring to disengage it from groove 3. At this point the pin 6 prevents the remainder of the plunger body from falling out of reach in a vertical conduit such as might be found at the bottom of a swimming pool. The pin thus keeps the plunger body accessible for service.

The plug 11 with its associated O-ring is removed after the split ring, then the lower body and spring can be removed.

After the necessary services are accomplished the component parts can be replaced in reverse order to the order of removal.

Although the invention is taught with reference to certain specified embodiments, it will be apparent to those skilled in the art from a consideration of the above disclosure that various changes in form and arrangement of parts may be made to suit requirements without departing from the spirit and scope of the invention.

What is claimed is:

1. Apparatus for intermittent delivery of a fluid under pressure from a source thereof comprising:

a. a hollow cylindrical housing;

b. a cylindrical plunger disposed within said housing comprising:

(1) a body;

(2) means defining a delivery head at one end of said body; and (3) means defining a piston at the other end of said body;

c. means defining an axial fluid conduit communicating between the two ends of said body and defining an intake orifice in said piston end and a delivery orifice adapted to direct a flow of fluid under pressure in a selected direction from said head;

d. means for reciprocating and incrementally rotating said plunger body within said housing between a ready position wherein said head is flush with an end of said housing and a fluid delivery position wherein said head is extended out of said housing, comprising:

(1) means for simultaneously rotating and axially advancing said body responsive to pressure from said source of fluid comprising at least one rotator bore disposed in said body at an angle to the direction of flow of the fluid whereby the fluid pressure will rotate said plunger;

(2) means for limiting the length of the axial and rotary travel of said body between a ready position and a delivery position; and (3) means for returning said body to said ready position; and e. means for connecting said intake orifice with a source of fluid under pressure.

2. The apparatus of claim 1 wherein said apparatus is adapted for water delivery in swimming pools.

3. The apparatus of claim 1 wherein said piston carries a radially extending flange, said rotator bore is a plurality of bores in said flange communicating between the high pressure side of said piston and the low pressure side; with the addition of relief ports in said body communicating between the low side of said flange and the interior of said conduit.

4. The apparatus of claim 1 wherein said rotator bore is disposed in said delivery head.

5. The apparatus of claim 1 wherein said rotator bore is the bore of claims 3 and 4 in combination.

6. The apparatus of claim 1 wherein said means for returning said plunger to said ready position is a helical spring disposed around said plunger and means for compressing said spring as the plunger is advanced from ready to delivery positions under the pressure of the fluid, whereby the pressure overcomes the force of said spring and the spring returns the plunger to ready when pressure is removed.

7. The apparatus of claim 1 wherein means for limiting the axial and rotary travel of said plunger comprises a rim extending radially inward from the interior walls of said housing and means carried by said plunger for frictionally engaging said rim.

8. The apparatus of claim 7 wherein said head is removable from said body, said rim is removable from said housing and, when removed, permits the removal of the entire plunger.

9. The apparatus of claim 1 with the addition of means for preventing the axial movement of said plunger past the ready position in the direction of the source of pressure.

10. The apparatus of claim 9 wherein said additional means comprises a washer disposed between said rim and said delivery head.

11. The apparatus of claim 10 wherein said washer is adjustable and serves a second function of adjusting the stroke of said plunger.

12. The apparatus of claim 3 wherein the bores in said piston are smaller than said relief ports.

13. The apparatus of claim 1 wherein said axial conduit is relieved at the intake orifice.

14. The apparatus of claim 4 wherein said delivery orifice is tapered as it extends axially outward to the perimeter of said delivery head.

15. The apparatus of claim 14 wherein a stream straightener is placed in said delivery orifice as it turns from axial to radial in its direction.

16. The apparatus of claim 1 wherein said means for limiting the axial and rotary travel of said plunger toward delivery position comprises an axial aperture for reception of a portion of said plunger body for reciprocal axial motion and a plate having radially projecting fingers, opposed slots in the inner wall of said housing comprising vertical legs longitudinally from the lip end of said housing and communicating horizontal legs extending at an angle from said vertical legs for the locking reception of said fingers, and means for moving said plate in and out of locking position in combination with an adjustable washer carried by said waist between said delivery head and said plate.

* * * * *